US010207505B1

(12) United States Patent
Simon et al.

(10) Patent No.: US 10,207,505 B1
(45) Date of Patent: Feb. 19, 2019

(54) METHOD FOR FABRICATING A CHARGING DEVICE

(71) Applicant: Eastman Kodak Company, Rochester, NY (US)

(72) Inventors: Robert J. Simon, Bellbrook, OH (US); Michael Frank Baumer, Dayton, OH (US); James E. Harrison, Jr., New Lebanon, OH (US); Brian George Morris, Dayton, OH (US); Charles D. Rike, Lebanon, OH (US)

(73) Assignee: EASTMAN KODAK COMPANY, Rochester, NY (US)

( * ) Notice: Subject to any disclaimer, the term of this patent is extended or adjusted under 35 U.S.C. 154(b) by 0 days.

(21) Appl. No.: 15/864,229

(22) Filed: Jan. 8, 2018

(51) Int. Cl.
*B41J 2/02* (2006.01)
*B41J 2/16* (2006.01)

(52) U.S. Cl.
CPC ..... *B41J 2/1642* (2013.01); *B41J 2/162* (2013.01)

(58) Field of Classification Search
CPC ..... B41J 2/09; B41J 2002/022; B41J 2/085; B41J 2/115; B41J 2/095; B41J 2/12
See application file for complete search history.

(56) References Cited

U.S. PATENT DOCUMENTS 3,852,768 A 12/1974 Carmichael et al.
3,878,519 A 4/1975 Eaton
3,949,410 A 4/1976 Bassous et al.
6,158,844 A * 12/2000 Murakami ..... B41J 2/06 347/55
6,367,917 B1 4/2002 Zaba
6,457,807 B1 10/2002 Hawkins et al.
6,491,362 B1 12/2002 Jeanmaire
6,505,921 B2 1/2003 Chwalek et al.
6,554,410 B2 4/2003 Jeanmaire et al.
6,575,566 B1 6/2003 Jeanmaire et al.
6,588,888 B2 7/2003 Jeanmaire et al.
6,793,328 B2 9/2004 Jeanmaire
6,827,429 B2 12/2004 Jeanmaire et al.
6,851,796 B2 2/2005 Jeanmaire et al.
7,073,896 B2 * 7/2006 Steiner ..... B41J 2/07 347/74
7,080,897 B2 * 7/2006 Yang ..... B41J 2/02 347/54

(Continued)

FOREIGN PATENT DOCUMENTS

EP 1013424 9/2007
EP 1013426 12/2007

*Primary Examiner* — Jaehwan Oh
(74) *Attorney, Agent, or Firm* — Kevin E. Spaulding

(57) ABSTRACT

A method of fabricating a charging device for an inkjet printing system includes providing a charging device body having at least one conductive trace passing through the interior of the charging device body connecting between a charging face of the charging device body and an interconnection region remote from the charging face. A portion of the at least one conductive trace is exposed on the charging face. A vapor deposition process is used to deposit a conductive base layer through a shadow mask onto the charging face, wherein the deposited conductive base layer contacts the exposed portion of at least one conductive trace. One or more conductive metallic layers are plated onto the deposited conductive base layer to form a charging electrode.

18 Claims, 14 Drawing Sheets

(56) References Cited

U.S. PATENT DOCUMENTS

| | | | | |
|---|---|---|---|---|
| 7,156,488 | B2 | 1/2007 | Morris et al. | |
| 7,163,281 | B2 | 1/2007 | Simon et al. | |
| 7,246,890 | B2 * | 7/2007 | Yamada | B41J 2/0451 347/54 |
| 7,249,828 | B2 * | 7/2007 | Gelbart | B41J 2/085 347/74 |
| 7,641,325 | B2 * | 1/2010 | Steiner | B41J 2/03 347/76 |
| 7,938,516 | B2 * | 5/2011 | Piatt | B41J 2/115 347/73 |
| 8,087,740 | B2 | 1/2012 | Piatt et al. | |
| 8,585,189 | B1 * | 11/2013 | Marcus | B41J 2/09 347/77 |
| 8,621,633 | B2 | 12/2013 | Kim | |
| 8,641,175 | B2 * | 2/2014 | Panchawagh | B41J 2/09 347/10 |
| 8,651,632 | B2 | 2/2014 | Marcus | |
| 8,696,094 | B2 * | 4/2014 | Marcus | B41J 2/03 347/74 |
| 8,740,359 | B2 * | 6/2014 | Piatt | B41J 2/09 347/73 |
| 8,888,256 | B2 | 11/2014 | Marcus et al. | |
| 8,919,934 | B2 * | 12/2014 | Ikegawa | B41J 2/09 347/73 |
| 8,926,071 | B2 * | 1/2015 | Sekiya | B41J 2/09 347/73 |

* cited by examiner

METHOD FOR FABRICATING A CHARGING DEVICE

FIELD OF THE INVENTION

This invention relates generally to the field of digitally-controlled printing devices, and in particular to charging electrodes for use in continuous printing systems in which a liquid stream breaks into printing drops and non-printing drops, wherein the non-printing drops are charged and deflected away from a printing drop trajectory.

BACKGROUND OF THE INVENTION

Continuous inkjet printing is a printing technology that is well suited for high-speed printing applications, having high throughput and low cost per page. Recent advances in continuous inkjet printing technology have included thermally induced drop formation, which is capable of selectively altering the drop breakoff phase relative to a periodic charging electrode waveform and thereby controlling whether the drop is charged or uncharged, and electrostatic deflection of charged drops to separate the charged non-print drops from the uncharged print drops. These advances have enabled the print resolution to be significantly improved while maintaining the throughput of the printer.

As discussed in commonly-assigned European Patent 1013424, drop charging and deflection depend on the charging voltage and the spacing between the charging electrode and the liquid streams from which the drops break off. Deviations in charging electrode flatness across the length of the nozzle array can therefore result in variation in impact height of the non-print drops on the catcher. Such variations in impact height tend to reduce the operating latitude of the printhead. As noted in commonly-assigned U.S. Pat. No. 7,163,281, the heating of the charging device to prevent condensation on the charging device can thermally deform the charging device altering the spacing between the charging electrode and the liquid streams, and thereby affecting the operating latitude of the printhead.

As discussed in commonly-assigned U.S. Pat. No. 7,156,488, when printheads have reduced nozzle sizes, which is desirable for higher quality color printing, the operations for removing contaminants from sensitive components can leave ink in the gap between the charging device and the nozzle plate. Failure to remove ink from this space can result in electrical shorting conditions between any exposed conductive traces on the upper surface of the charging device and other conductive surface in the printhead. These types of shorting conditions often result in printhead errors and premature printhead failure. To prevent such electrical shorting conditions, prior art systems have typically applied an insulating layer such as an insulating epoxy layer over the conductive traces on the upper surface of the charging device. While such insulating layers do provide protection for the conductive traces on the charging device, the presence of the insulating layer on the upper surface of the charging device reduces the size of the gap between the charging device and the nozzle plate which can further impede the removal of ink from the gap between the charging device and the nozzle plate. Furthermore, under prolonged exposure to the ink, the insulating epoxy layers have been found to degrade.

There remains a need for an improved charging device construction that provides very uniform drop charging and deflection across the nozzle array, that undergoes minimal thermal deformation during operation, and that provides superior insulation of the charging electrode conductive traces without encroaching into the gap between the charge device and the nozzle plate.

SUMMARY OF THE INVENTION

The present invention represents a method of fabricating a charging device for an inkjet printing system, including:

providing a charging device body having at least one conductive trace passing through the interior of the charging device body connecting between a charging face of the charging device body and an interconnection region remote from the charging face, a portion of the at least one conductive trace being exposed on the charging face;

using a vapor deposition process to deposit a conductive base layer through a shadow mask onto the charging face, the deposited conductive base layer contacting the exposed portion of at least one conductive trace; and plating a conductive metallic layer onto the conductive base layer to form a charging electrode.

This invention has the advantage that the combination of using a charging device body with a conductive trace passing through the interior of the charging device body from the charging face to the electrical connector with the step of depositing the base layer on the charging face using a shadow mask makes it is possible to define the boundaries of the charging electrode without the need for photomasking operations. This allows the upper edge of the charging electrode to be placed with high accuracy to under 75 microns from the corner between the charging face and the top face of the charging device, and preferably between 25 and 30 microns from the top corner of the charging device, which can't readily be accomplished using conventional photomasking operations to define the upper boundary of the charging electrode.

It has the additional advantage that the invention produces a charging device with an encapsulated internal heater, making the heater immune to attack by the inkjet inks or other fluids. The encapsulation of the heater also provides excellent thermal contact between the heater and the ceramic charging device body. This enables much lower heater power to be used than has been required with prior art heaters. Embedding the heater between the ceramic layers of the charging device body also reduces the thermal expansion distortion of the charging device.

BRIEF DESCRIPTION OF THE DRAWINGS

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

The example embodiments of the present invention are illustrated schematically and not to scale for the sake of clarity. One of the ordinary skills in the art will be able to readily determine the specific size and interconnections of the elements of the example embodiments of the present invention.

As described herein, exemplary embodiments of the present invention provide a printhead or printhead components typically used in inkjet printing systems. However, many other applications are emerging which use printheads to emit liquids (other than inks) that need to be finely metered and deposited with high spatial precision. As such, as described herein, the terms "liquid" and "ink" refer to any material that can be ejected by the printhead or printhead components described below.

Figure 1:
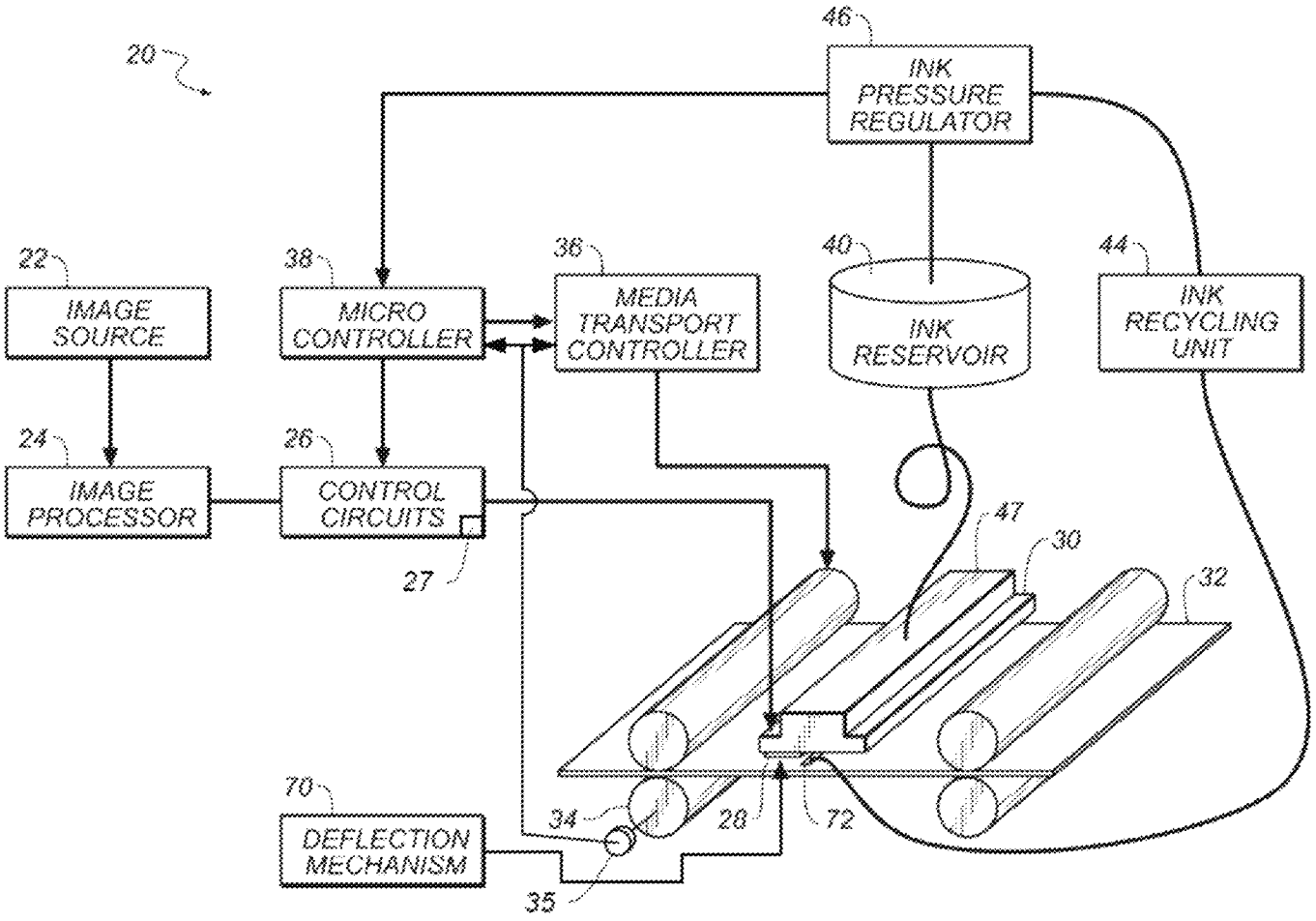
FIG. 1 (Prior Art)
FIG. 1 is a simplified block schematic diagram of an exemplary continuous inkjet system.

Referring to FIG. 1, a continuous printing system 20 includes an image source 22 such as a scanner or computer which provides raster image data, outline image data in the form of a page description language, or other forms of digital image data. This image data is converted to half-toned bitmap image data by an image processing unit (image processor) 24 which also stores the image data in memory. A plurality of drop-forming transducer control circuits 26 reads data from the image memory and apply time-varying electrical pulses to a drop-forming transducers 28 that are associated with one or more nozzles of a printhead 30. These pulses are applied at an appropriate time, and to the appropriate nozzles, so that drops formed from a continuous inkjet stream will form spots on a print medium 32 in the appropriate position designated by the data in the image memory.

Print medium 32 is moved relative to the printhead 30 by a print medium transport system 34, which is electronically controlled by a media transport controller 36 in response to signals from a speed measurement device 35. The media transport controller 36 is in turn is controlled by a microcontroller 38. The print medium transport system 34 shown in FIG. 1 is a schematic only, and many different mechanical configurations are possible. For example, a transfer roller could be used in the print medium transport system 34 to facilitate transfer of the ink drops to the print medium 32. Such transfer roller technology is well known in the art. In the case of page width printheads, it is most convenient to move the print medium 32 along a media path past a stationary printhead. However, in the case of scanning print systems, it is often most convenient to move the printhead along one axis (the sub-scanning direction) and the print medium 32 along an orthogonal axis (the main scanning direction) in a relative raster motion.

Ink is contained in an ink reservoir 40 under pressure. In the non-printing state, continuous inkjet drop streams are unable to reach print medium 32 due to an ink catcher 72 that blocks the stream of drops, and which may allow a portion of the ink to be recycled by an ink recycling unit 44. The ink recycling unit 44 reconditions the ink and feeds it back to the ink reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to the ink reservoir 40 under the control of an ink pressure regulator 46. Alternatively, the ink reservoir 40 can be left unpressurized, or even under a reduced pressure (vacuum), and a pump can be employed to deliver ink from the ink reservoir 40 under pressure to the printhead 30. In such an embodiment, the ink pressure regulator 46 can include an ink pump control system. The ink is distributed to the printhead 30 through an ink channel 47. The ink preferably flows through slots or holes etched through a silicon substrate of printhead 30 to its front surface, where a plurality of nozzles and drop-forming transducers, for example, heaters, are situated. When printhead 30 is fabricated from silicon, the drop-forming transducer control circuits 26 can be integrated with the printhead 30. The printhead 30 also includes a deflection mechanism 70 which is described in more detail below with reference to FIGS. 2 and 3.

Figure 2:
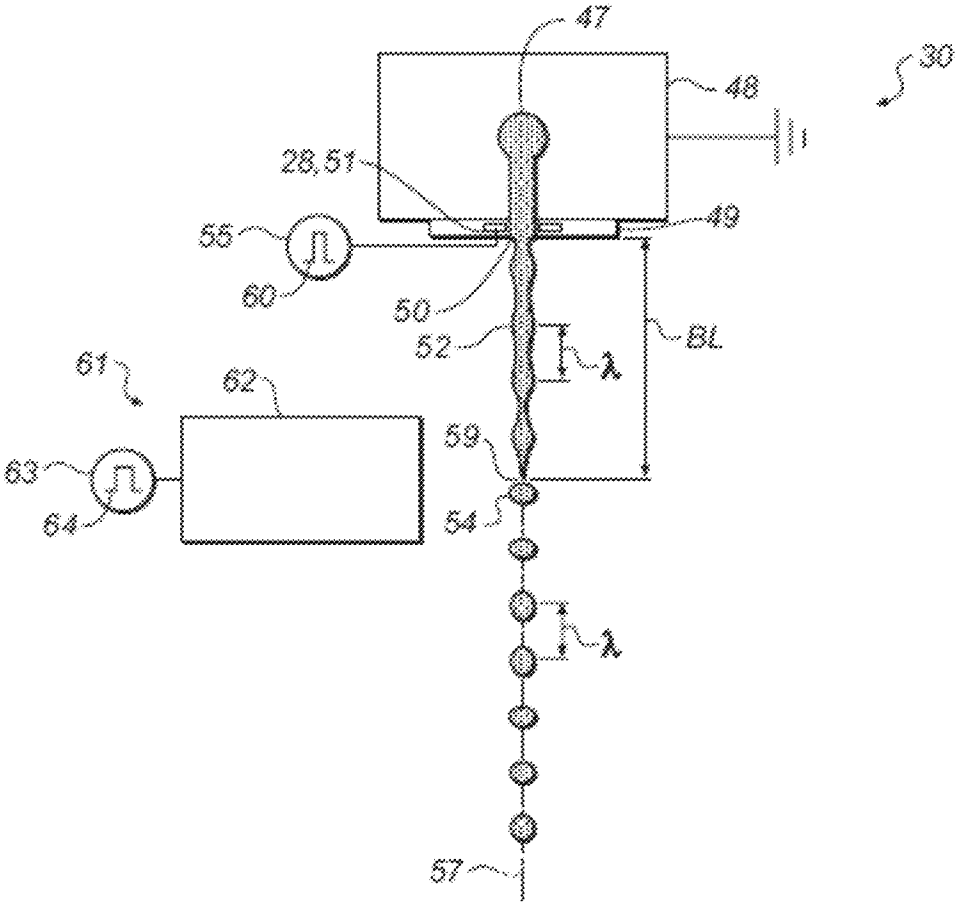
FIG. 2 (Prior Art)
FIG. 2 illustrates a liquid jet being ejected from a drop generator and its subsequent break off into drops with a regular period.

Referring to FIG. 2, a schematic view of continuous liquid printhead 30 is shown. A jetting module 48 of printhead 30 includes an array of nozzles 50 formed in a nozzle plate 49. In FIG. 2, nozzle plate 49 is affixed to the jetting module 48. Alternatively, the nozzle plate 49 can be integrally formed with the jetting module 48. Liquid, for example, ink, is supplied to the nozzles 50 via ink channel 47 at a pressure sufficient to form continuous liquid streams 52 (sometimes referred to as filaments) from each nozzle 50. In FIG. 2, the array of nozzles 50 extends into and out of the figure.

Jetting module 48 is operable to cause liquid drops 54 to break off from the liquid stream 52 in response to image data. To accomplish this, jetting module 48 includes a drop stimulation or drop-forming transducer 28, which, when selectively activated, perturbs the liquid stream 52, to induce portions of each filament to break off and coalesce to form the drops 54. Examples of drop-forming transducer 28 include thermal devices such as heaters for heating the ink, MEMS piezoelectric, electrostrictive or thermal actuators such as are disclosed in commonly-assigned U.S. Pat. No. 8,087,740 (Piatt et al.), electrohydrodynamic devices such as disclosed in U.S. Pat. No. 3,949,410 (Bassous et al.), or optical devices such as those disclosed in U.S. Pat. No. 3,878,519 (Eaton). Depending on the type of transducer used, the transducer can be located in or adjacent to the liquid chamber that supplies the liquid to the nozzles 50 to act on the liquid in the liquid chamber, can be located in or immediately around the nozzles 50 to act on the liquid as it passes through the nozzle, or can be located adjacent to the liquid stream 52 to act on the liquid stream 50 after it has passed through the nozzle 50.

In FIG. 2, the drop-forming transducer 28 is a heater 51, for example, an asymmetric heater or a ring heater (either segmented or not segmented), located in the nozzle plate 49 on one or both sides of the nozzle 50. This type of drop formation is known and has been described in, for example, U.S. Pat. No. 6,457,807 (Hawkins et al.); U.S. Pat. No. 6,491,362 (Jeanmaire); U.S. Pat. No. 6,505,921 (Chwalek et al.); U.S. Pat. No. 6,554,410 (Jeanmaire et al.); U.S. Pat. No. 6,575,566 (Jeanmaire et al.); U.S. Pat. No. 6,588,888 (Jeanmaire et al.); U.S. Pat. No. 6,793,328 (Jeanmaire); U.S. Pat. No. 6,827,429 (Jeanmaire et al.); and U.S. Pat. No. 6,851,796 (Jeanmaire et al.), each of which is incorporated herein by reference.

Typically, one drop-forming transducer 28 is associated with each nozzle 50 of the nozzle array. However, in some configurations, a drop-forming transducer 28 can be associated with groups of nozzles 50 in the nozzle array. Referring to FIG. 2 the printing system has associated with it, a printhead 30 that is operable to produce, from an array of nozzles 50, an array of liquid streams 52, also called liquid jets. A drop-forming device is associated with each liquid stream 52. The drop-formation device includes a drop-forming transducer 28 and a drop-formation waveform source 55 that supplies a drop-formation waveform sequence 60 to the drop-forming transducer 28. The drop-formation waveform source 55 is a portion of the mechanism control circuits 26. In some embodiments in which the nozzle plate is fabricated of silicon, the drop-formation waveform source 55 is formed at least partially on the nozzle plate 49. The drop-formation waveform source 55 supplies a drop-formation waveform sequence 60, which typically includes a sequence of pulses having a fundamental frequency $f_O$ and a fundamental period of $T_O=1/f_O$, to the drop-formation transducer 28, which produces a modulation in the diameter of the liquid stream; the modulation having a wavelength $\lambda$ along the liquid stream. The jet-diameter modulation moves with the flowing liquid down the liquid stream and it grows in amplitude, causing the larger diameter portions of the liquid stream to further increase in diameter and the smaller diameter portions of the liquid stream to decrease further in diameter. The modulation amplitude grows until, at a distance BL from the nozzle plate 49, the small diameter portions of the liquid stream shrink to a diameter of zero, causing the end portion of the liquid stream 52 to break off into drops 54. Through the action of the drop-formation device, a sequence of drops 54 is produced. In accordance with the drop-formation waveform sequence 60, the drops 54 are formed at the fundamental frequency $f_O$ with a fundamental period of $T_O=1/f_O$. In FIG. 2, liquid stream 52 breaks off into drops with a regular period at breakoff point 59, which is a distance, called the break off length, BL from the nozzle 50. The distance between a pair of successive drops 54 is essentially equal to the wavelength $\lambda$ of the perturbation on the liquid stream 52. The stream of drops 54 formed from the liquid stream 52 follow an initial trajectory 57.

The time from when a drop-formation waveform pulse is applied to the drop-formation transducer until the jet-diameter modulation produced by the waveform pulse causes a portion of the liquid stream to break off as a drop is called the break-off time BOT. The break-off time BOT of the droplet for a particular printhead can be altered by changing at least one of the amplitude, duty cycle, or number of the stimulation pulses to the respective resistive elements surrounding a respective resistive nozzle orifice, all of which alter the initial modulation amplitude on the liquid stream. In this way, small variations of either pulse duty cycle or amplitude allow the droplet break-off times to be modulated in a predictable fashion within ±one-tenth the droplet generation period.

Also, shown in FIG. 2, is a charging device 61 comprising charging electrode 62 and charging-electrode waveform source 63. The charging electrode 62 associated with the liquid jet is positioned adjacent to the breakoff point 59 of the liquid stream 52. If a voltage is applied to the charging electrode 62, electric fields are produced between the charging electrode and the electrically grounded liquid jet, and the capacitive coupling between the two produces a net charge on the end of the electrically conductive liquid stream 52. (The liquid stream 52 is grounded by means of contact with the liquid chamber of the grounded drop generator.) If the end portion of the liquid jet breaks off to form a drop while there is a net charge on the end of the liquid stream 52, the charge of that end portion of the liquid stream 52 is trapped on the newly formed drop 54.

Figure 4:
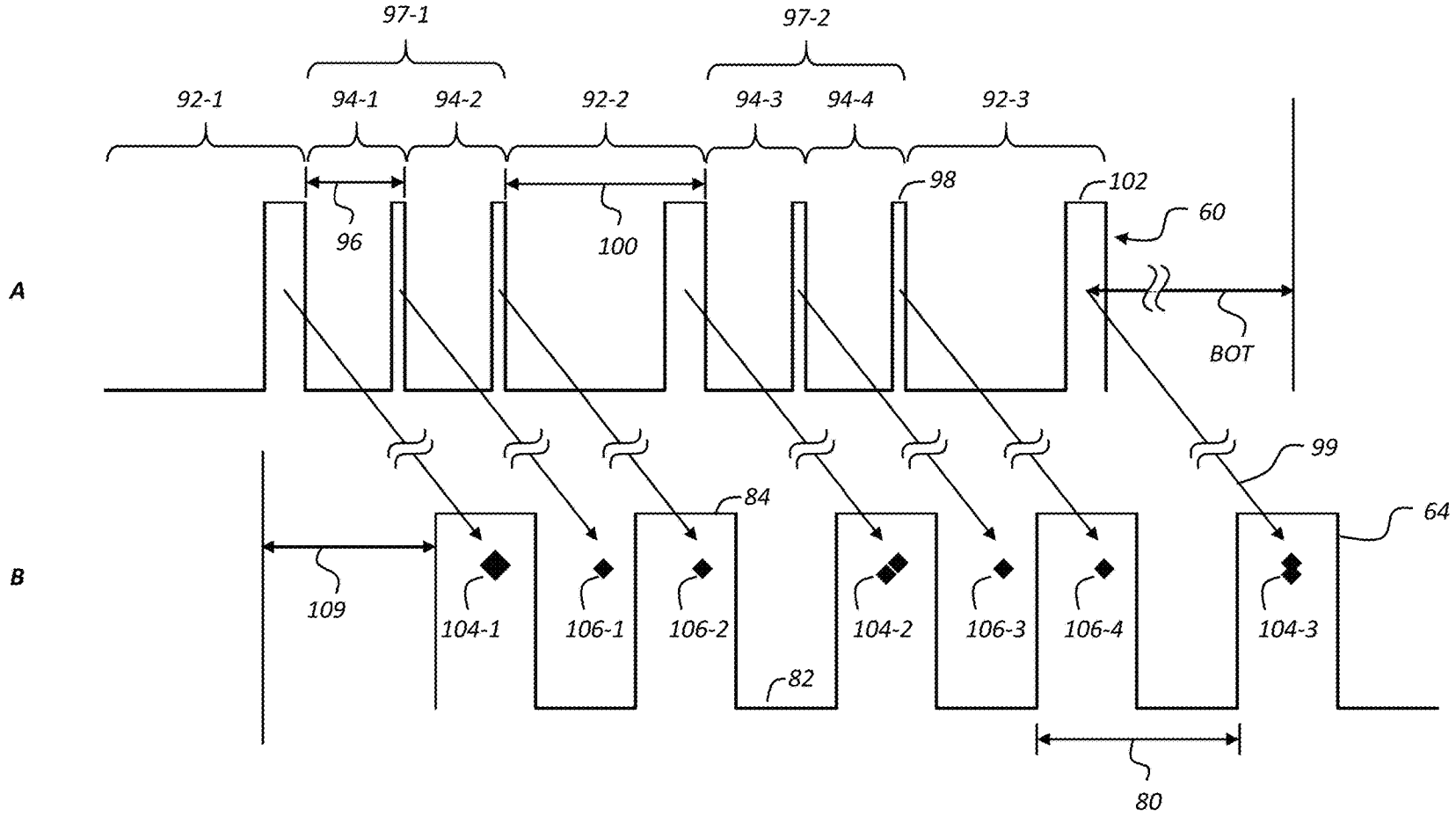
FIG. 4 (Prior Art)
FIG. 4 shows an exemplary timing diagram illustrating drop-formation pulses and a charging-electrode waveform.

The voltage on the charging electrode 62 is controlled by the charging-electrode waveform source 63, which provides a charging-electrode waveform 64 operating at a charging-electrode waveform 64 period 80 (shown in FIG. 4). The charging-electrode waveform source 63 provides a varying electrical potential between the charging electrode 62 and the liquid stream 52. The charging-electrode waveform source 63 generates a charging-electrode waveform 64, which includes a first voltage state and a second voltage state; the first voltage state being distinct from the second voltage state. An example of a charging-electrode waveform is shown in part B of FIG. 4. The two voltages are selected such that the drops 54 breaking off during the first voltage state acquire a first charge state and the drops 54 breaking off during the second voltage state acquire a second charge state. The charging-electrode waveform 64 supplied to the charging electrode 62 is independent of, or not responsive to, the image data to be printed. The charging device 61 is synchronized with the drop-formation device using a conventional synchronization device 27, which is a portion of the control circuits 26, (see FIG. 1) so that a fixed phase relationship is maintained between the charging-electrode waveform 64 produced by the charging-electrode waveform source 63 and the clock of the drop-formation waveform source 55. As a result, the phase of the break off of drops 54 from the liquid stream 52, produced by the drop-formation waveforms 92-1, 92-2, 92-3, 94-1, 94-2, 94-3, 94-4 (see FIG. 4), is phase locked to the charging-electrode waveform 64. As indicated in FIG. 4, there can be a phase shift 109 (or equivalently a time shift) between the charging-electrode waveform 64 and the drop-formation waveforms 92-1, 92-2, 92-3, 94-1, 94-2, 94-3, 94-4.

Figure 3:
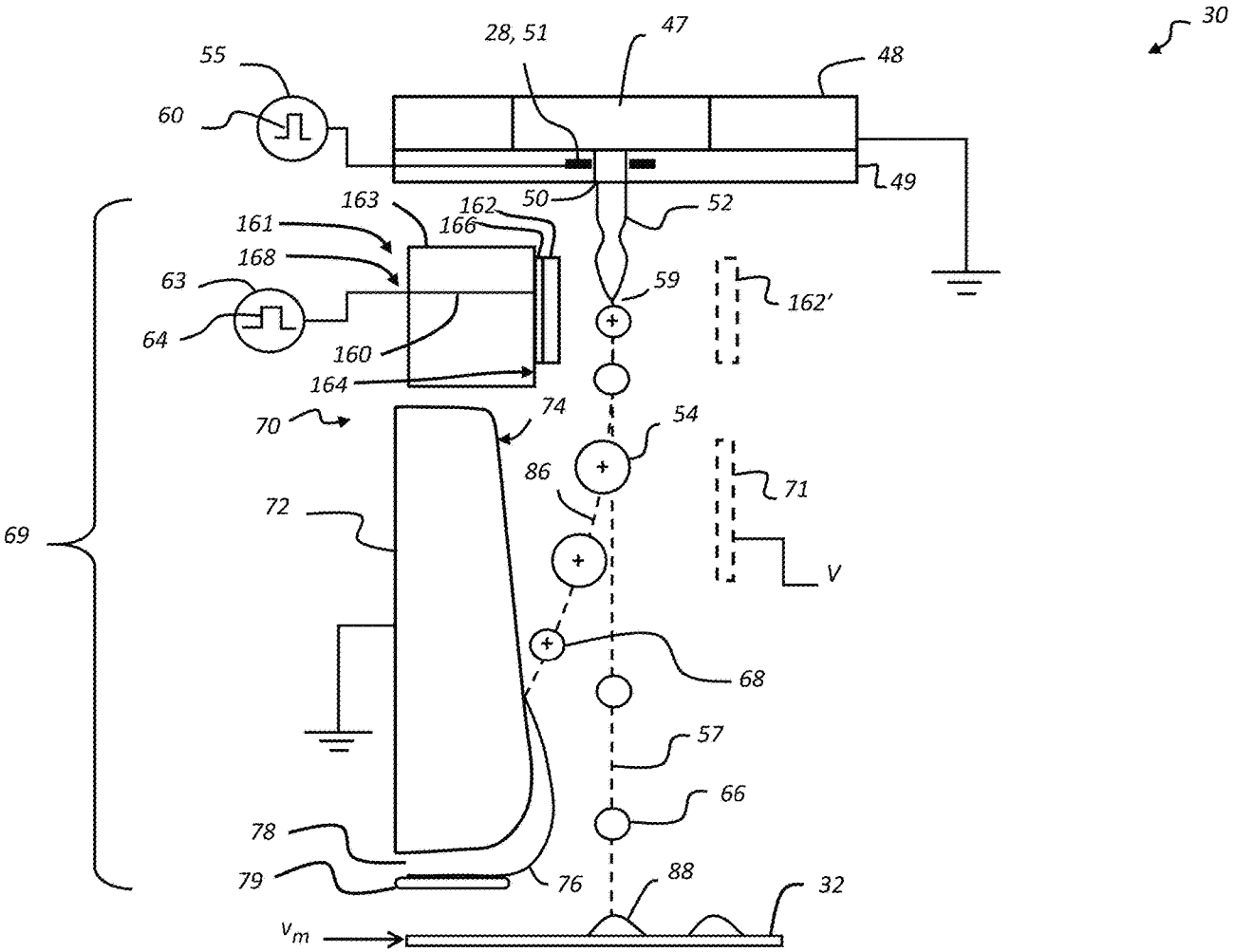
FIG. 3 shows a cross-sectional view of an exemplary inkjet printhead of a continuous liquid ejection system in accordance with the present invention.

With reference now to FIG. 3, printhead 30 includes a drop-forming transducer 28 which creates a liquid stream 52 that breaks up into ink drops 54. Selection of drops 54 as printing drops 66 or non-printing drops 68 will depend upon the phase of the droplet break off relative to the charging electrode voltage pulses that are applied to the to a charging electrode 162 of an improved charging device 161 that is part of the deflection mechanism 70, as will be described below. The charging electrode 162 is variably biased by a charging-electrode waveform source 63. The charging-electrode waveform source 63 provides a charging-electrode waveform 64, in the form of a sequence of charging pulses. The charging-electrode waveform 64 is periodic, having a charging-electrode waveform period 80 (FIG. 4).

An embodiment of a charging-electrode waveform 64 is shown in part B of FIG. 4. The charging-electrode waveform 64 comprises a first voltage state 82 and a second voltage state 84. Drops breaking off during the first voltage state 82 are charged to a first charge state and drops breaking off during the second voltage state 84 are charged to a second charge state. The second voltage state 84 is typically at a high level, biased sufficiently to charge the drops 54 as they break off. The first voltage state 82 is typically at a low level relative to the printhead 30 such that the first charge state is relatively uncharged when compared to the second charge state. An exemplary range of values of the electrical potential difference between the first voltage state 82 and a second voltage state 84 is 50 to 300 volts and more preferably 90 to 150 volts.

Returning to a discussion of FIG. 3, when a relatively high-level voltage or electrical potential is applied to the charging electrode 162 and a drop 54 breaks off from the liquid stream 52 in front of the charging electrode 162, the drop 54 acquires a charge and is deflected by deflection mechanism 70 towards the ink catcher 72 as non-printing drop 68. The non-printing drops 68 that strike the catcher face 74 form an ink film 76 on the face of the ink catcher 72. The ink film 76 flows down the catcher face 74 and enters liquid channel 78 (also called an ink channel), through which it flows to the ink recycling unit 44. The liquid channel 78 is typically formed between the body of the ink catcher 72 and a lower plate 79.

Deflection occurs when drops 54 break off from the liquid stream 52 while the potential of the charging electrode 162 is provided with an appropriate voltage. The drops 54 will then acquire an induced electrical charge that remains upon the droplet surface. The charge on an individual drop 54 has a polarity opposite that of the charging electrode 162 and a magnitude that is dependent upon the magnitude of the voltage and the coupling capacitance between the charging electrode 162 and the drop 54 at the instant the drop 54 separates from the liquid jet 52. This coupling capacitance is dependent in part on the spacing between the charging electrode 162 and the drop 54 as it is breaking off. It can also be dependent on the vertical position of the breakoff point 59 relative to the center of the charge electrode 162. After the charged drops 54 have broken away from the liquid stream 52, they continue to pass through the electric fields produced by the charge plate. These electric fields provide a force on the charged drops deflecting them toward the charging electrode 162. The charging electrode 162, even though it cycled between the first and the second voltage states, thus acts as a deflection electrode to help deflect charged drops away from the initial trajectory 57 and toward the ink catcher 72. After passing the charging electrode 162, the drops 54 will travel in close proximity to the catcher face 74 which is typically constructed of a conductor or dielectric. The charges on the surface of the non-printing drops 68 will induce either a surface charge density charge (for a catcher face 74 constructed of a conductor) or a polarization density charge (for a catcher face 74 constructed of a dielectric). The induced charges on the catcher face 74 produce an attractive force on the charged non-printing drops 68. The attractive force on the non-printing drops 68 is identical to that which would be produced by a fictitious charge (opposite in polarity and equal in magnitude) located inside the ink catcher 72 at a distance from the surface equal to the distance between the ink catcher 72 and the non-printing drops 68. The fictitious charge is called an image charge. The attractive force exerted on the charged non-printing drops 68 by the catcher face 74 causes the charged non-printing drops 68 to deflect away from their initial trajectory 57 and accelerate along a non-print trajectory 86 toward the catcher face 74 at a rate proportional to the square of the droplet charge and inversely proportional to the droplet mass. In this embodiment, the ink catcher 72, due to the induced charge distribution, comprises a portion of the deflection mechanism 70. In other embodiments, the deflection mechanism 70 can include one or more additional electrodes to generate an electric field through which the charged droplets pass so as to deflect the charged droplets. For example, an optional single biased deflection electrode 71 in front of the upper grounded portion of the catcher can be used. In some embodiments, the charging electrode 162 can include a second portion on the second side of the jet array, denoted by the dashed line charging electrode 162', which is supplied with the same charging-electrode waveform 64 as the first portion of the charging electrode 162.

In the alternative, when the drop-formation waveform sequence 60 supplied to the drop-forming transducer 28 causes a drop 54 to break off from the liquid stream 52 when the electrical potential of the charging electrode 162 is at the first voltage state 82 (FIG. 4) (i.e., at a relatively low potential or at a zero potential), the drop 54 does not acquire a charge. Such uncharged drops are unaffected during their flight by electric fields that deflect the charged drops. The uncharged drops therefore become printing drops 66, which travel in a generally undeflected path along the trajectory 57 and impact the print medium 32 to form print dots 88 on the print medium 32, as the recoding medium is moved past the printhead 30 at a speed $V_m$. The charging electrode 162, deflection electrode 71 and ink catcher 72 serve as a drop selection system 69 for the printhead 30.

FIG. 4 illustrates how selected drops can be printed by the control of the drop-formation waveform sequence 60 supplied to the drop-forming transducer 28. Section A of FIG. 4 shows a drop-formation waveform sequence 60 that includes three large-drop drop-formation waveforms 92-1, 92-2, 92-3, and four small-drop drop-formation waveforms 94-1, 94-2, 94-3, 94-4. The small-drop drop-formation waveforms 94-1, 94-2, 94-3, 94-4 each have a period 96 and include a pulse 98, and each of the large-drop drop-formation waveforms 92-1, 92-2, 92-3 have a longer period 100 and include a longer pulse 102. In this example, the period 96 of the small-drop drop-formation waveforms 94-1, 94-2, 94-3, 94-4 is the fundamental period $T_O$, and the period 100 of the large-drop drop-formation waveforms 92-1, 92-2, 92-3 is twice the fundamental period, $2T_O$. The small-drop drop-formation waveforms 94-1, 94-2, 94-3, 94-4 each cause individual drops to break off from the liquid stream. The large-drop drop-formation waveforms 92-1, 92-2, 92-3, due to their longer period, each cause a larger drop 54 to be formed from the liquid stream 52. The larger drops 54 formed by the large-drop drop-formation waveforms 92-1, 92-2, 92-3 each have a volume that is approximately equal to twice the volume of the drops 54 formed by the small-drop drop-formation waveforms 94-1, 94-2, 94-3, 94-4.

As previously mentioned, the charge induced on a drop 54 depends on the voltage state of the charging electrode at the instant of drop breakoff. The B section of FIG. 4 shows the charging-electrode waveform 64 and the times, denoted by the diamonds, at which the drops 54 break off from the liquid stream 52. The large-drop drop-formation waveforms 92-1, 92-2, 92-3 cause large drops 104-1, 104-2, 104-3 to break off from the liquid stream 52 while the charging-electrode waveform 64 is in the second voltage state 84. Due to the high voltage applied to the charging electrode 62 in the second voltage state 84, the large drops 104-1, 104-2, 104-3 are charged to a level that causes them to be deflected as non-printing drops 68 such that they strike the catcher face 74 of the ink catcher 72 in FIG. 3. The small-drop drop-formation waveforms 94-1, 94-2, 94-3, 94-4 cause small drops 106-1, 106-2, 106-3, 106-4 to form. Arrows 99 denote the link between the waveforms and the drops that they cause to form. As previously mentioned, there is a break-off time interval BOT between the application of a waveform to the drop-formation transducer and the break off of the resulting drop 54. The breaks in the arrows 99 and the BOT arrow are present to indicate that the break-off time BOT is typically many times longer than the drop-formation waveform period 100. Small drops 106-1 and 106-3 break off during the first voltage state 82, and therefore will be relatively uncharged. Therefore, they are not deflected into the ink catcher 72, but rather pass by the ink catcher 72 as printing drops 66 and strike the print medium 32 (see FIG. 3). Small drops 106-2 and 106-4 break off during the second voltage state 84 and are deflected to strike the catcher face 74 as non-printing drops 68. The drop-formation waveform sequence 60 is determined by the print data, while the charging-electrode waveform 64 is not controlled by the pixel data to be printed. This type of drop deflection is known and has been described in, for example, U.S. Pat. No. 8,585,189 (Marcus et al.); U.S. Pat. No. 8,651,632 (Marcus); U.S. Pat. No. 8,651,633 (Marcus et al.); U.S. Pat. No. 8,696,094 (Marcus et al.); and U.S. Pat. No. 8,888,256 (Marcus et al.), each of which is incorporated herein by reference.

Figure 5:
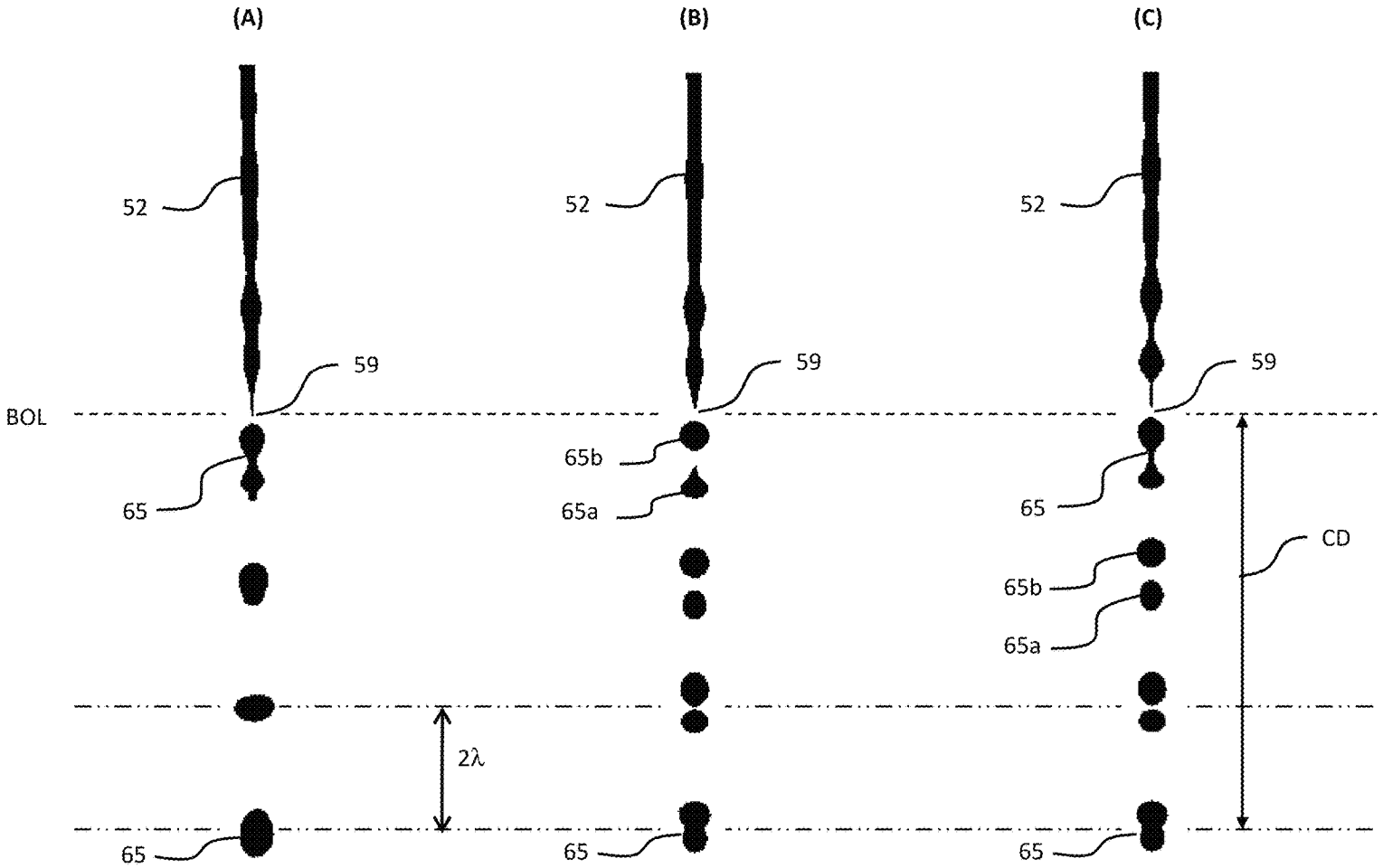
FIG. 5 (Prior Art)
FIG. 5 illustrates a liquid jet being ejected from a drop generator and its subsequent break off into drops.

As illustrated in part (A) of FIG. 5, the large drops 65 created by the large-drop drop-formation waveforms 92-1, 92-2, 92-3 (FIG. 4) may be formed as a single drop that remains a single drop. Under other conditions as illustrated in part (B) of FIG. 5, the large drops 65 can form as two drops 65*a* and 65*b* that break off from the liquid stream 52 at almost the same time that subsequently merge to form the large drop 65. Alternatively, as indicated in part (C) of FIG. 5, the large drop can form as a large drop 65 that breaks off from the liquid stream that breaks apart into two drops 65*a*, 65*b* and then merges back to a single large drop 65. The distance below the breakoff point 59 at which the drops 65*a* and 65*b* coalesce to form the large drop 65 is called the coalescence distance CD. It is generally desirable to keep the coalescence distance CD small. The large drop formation process of part (A) of FIG. 5 is denoted in FIG. 4 by the large diamond for large drop 104-1. The large drop formation process of part (B) of FIG. 5 is denoted in FIG. 4 by two closely spaced diamonds for large drop 104-2, and the large drop formation process of part (C) of FIG. 5 is denoted in FIG. 4 by the double diamond for large drop 104-3.

For each nozzle in the nozzle array, a drop-formation waveform sequence 60 including a sequence of large-drop drop-formation waveforms 92-1, 92-2, 92-3 of FIG. 4 and small-drop drop-formation waveforms 94-1, 94-2, 94-3, 94-4 of FIG. 4 is created by the by the drop-formation waveform source 55 in response to the image data to be printed. When the image data for a particular nozzle requires a print drop is to be formed, a pair of small-drop drop-formation waveforms 94-1, 94-2, 94-3, 94-4 is added to the waveform sequence 60 for that nozzle, and conversely when no print drop is to be created, a large-drop drop-formation waveform 92-1, 92-2, 92-3, which can also be referred to as a non-printing drop-formation waveform, is added to the waveform sequence 60 for that nozzle. As the small-drop drop-formation waveforms 94-1, 94-2, 94-3, 94-4 are always added to the drop-formation waveform sequence 60 in pairs whenever a print drop is required, the pair of small-drop drop-formation waveforms 94-1, 94-2 is herein considered to be a printing-drop drop-formation waveform 97-1). The printing-drop drop-formation waveform 97-1 can also be referred to as a drop-pair drop-formation waveform or more simply as a printing drop-formation waveform. The printing-drop drop-formation waveform 97-1 has the same period 96 as the non-printing drop-formation waveform 92-1, 92-2, 92-3. In FIG. 4, the small-drop drop-formation waveforms 94-1, 94-2 together form the printing-drop drop-formation waveform 97-1, and the small-drop drop-formation waveforms 94-3, 94-4 together form the printing-drop drop-formation waveform 97-2.

In accordance with the present invention, the improved charging device 161 of FIG. 3 includes at least one conductive trace 160 which passes through the interior of the charging device body 163 to deliver an electrical signal from the charging-electrode waveform source 63 to the charging electrode 162, which is positioned on a charging face 164 of the charging device which faces the liquid stream 52. The charging-electrode waveform source 63 is connected to the conductive trace 160 in an interconnect region 168. By directing the conductive trace 160 through the interior of the charging device body 163 rather than over the top as in prior art designs, the conductive trace 160 is insulated from electrical shorts caused by exposure to ink in the region between the charging device 161 and the nozzle plate 49, and further allows the spacing between the charging device 161 and the nozzle plate 49 to be minimized. In an exemplary embodiment, the charging electrode 162 is deposited over a base layer 166 using an electroplating process. The base layer 166 is preferably formed using a vapor deposition process.

Figure 6:
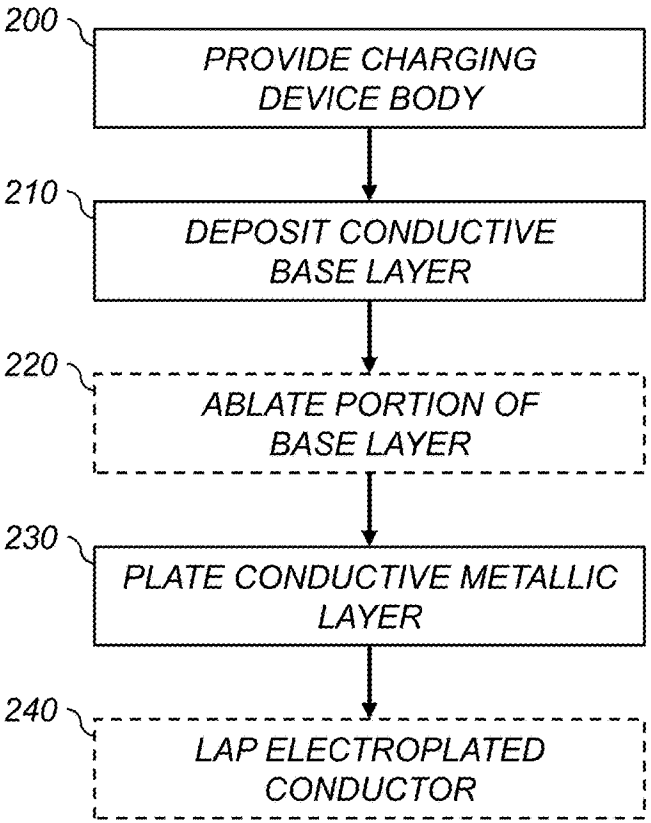
FIG. 6 shows a flowchart of a process for fabricating a charging device in accordance with an exemplary embodiment.

FIG. 6 shows a flowchart of an exemplary process for fabricating the improved charging device 161 of FIG. 3. The process begins with a provide charging device body step 200 in which a charging device body 163 is provided that includes one or more conductive traces 160 that pass through the interior of the charging device body 163 connecting between the charging face 164 and the interconnect region 168 of the charging device 161, the interconnection region 168 being remote from the charging face 164. In an exemplary configuration, the interconnection region 168 is on a back face of the charging device body 163 opposite to the charging face 164 or is on a bottom face of the charging device body 163 away from the nozzle plate 49. An edge of the one or more conductive traces 160 is exposed on the charging face 164 of the charging device body 163.

In deposit conductive base layer step 210, a thin conductive base layer 166 is deposited onto the charging face 164 of the charging device 161. The thin conductive base layer 166 makes electrical contact with the exposed edge of the one or more conductive traces 160. In a preferred embodiment, the thin conductive base layer 166 is made by depositing one or more layers of conductive material using a physical vapor deposition process such a sputtering process, pulse laser deposition, or evaporative deposition process. A chemical vapor deposition process can also be used. Such deposition processes are well-known in the art, and any appropriate process can be used in accordance with the present invention. In an exemplary embodiment, the deposited conductive material includes a first layer of chromium and a second layer of copper. A shadow mask is preferably used during the deposition process to define the perimeter of the deposited conductive base layer 166 on charging face 164 of the charging device 161. In an optional ablate portion of base layer step 220, the perimeter of the deposited base layer 166 is further refined by means of laser ablation.

In a plate conductive metallic layer step 230, a conductive metallic layer is plated onto the deposited base layer 166 to provide the charging electrode 162. Any appropriate plating process known in the art can be used to deposit the conductive metallic layer in accordance with the present invention. In a preferred embodiment, the plating process is an electroplating process which deposits one or more layers of conductive material. In other embodiments, an electroless plating process can be used which deposits the conductive material using the base layer 166 as a catalyst. In an exemplary embodiment, the plating process forms the charging electrode 162 by first depositing a layer of copper and then depositing a layer of nickel.

In an optional lap electroplated conductor step 240, the plated charging electrode 162 is lapped to a specified flatness. Lapping processes are well-known in the art, and any appropriate lapping process can be used in accordance with the present invention. In a preferred embodiment, the lapping process laps the charging electrode 162 to a flatness of 5 microns or less.

In a preferred embodiment, the charging device body 163 is made up of a plurality of non-conductive, geometrically-stable layers with the one or more conductive traces 160 being located between the layers. In an exemplary configuration, the non-conductive, geometrically-stable layers are each made of an alumina or other ink-compatible ceramic. On at least some of the non-conductive, geometrically-stable layers a conductive pattern is applied to provide the one or more conductive traces 160. In certain embodiments, vias through one or more of the non-conductive, geometrically-stable layers can be used to interconnect the conductive traces that are separated by the non-conductive, geometrically-stable layers. An exemplary process for fabricating the ceramic layers with the vias, applying the desired conductive patterns to the layers, assembling layers, and co-firing the assembly is known and available through Advanced Technical Ceramics Company of Chattanooga, Tenn., also known as Adtech Ceramics.

Figure 7:
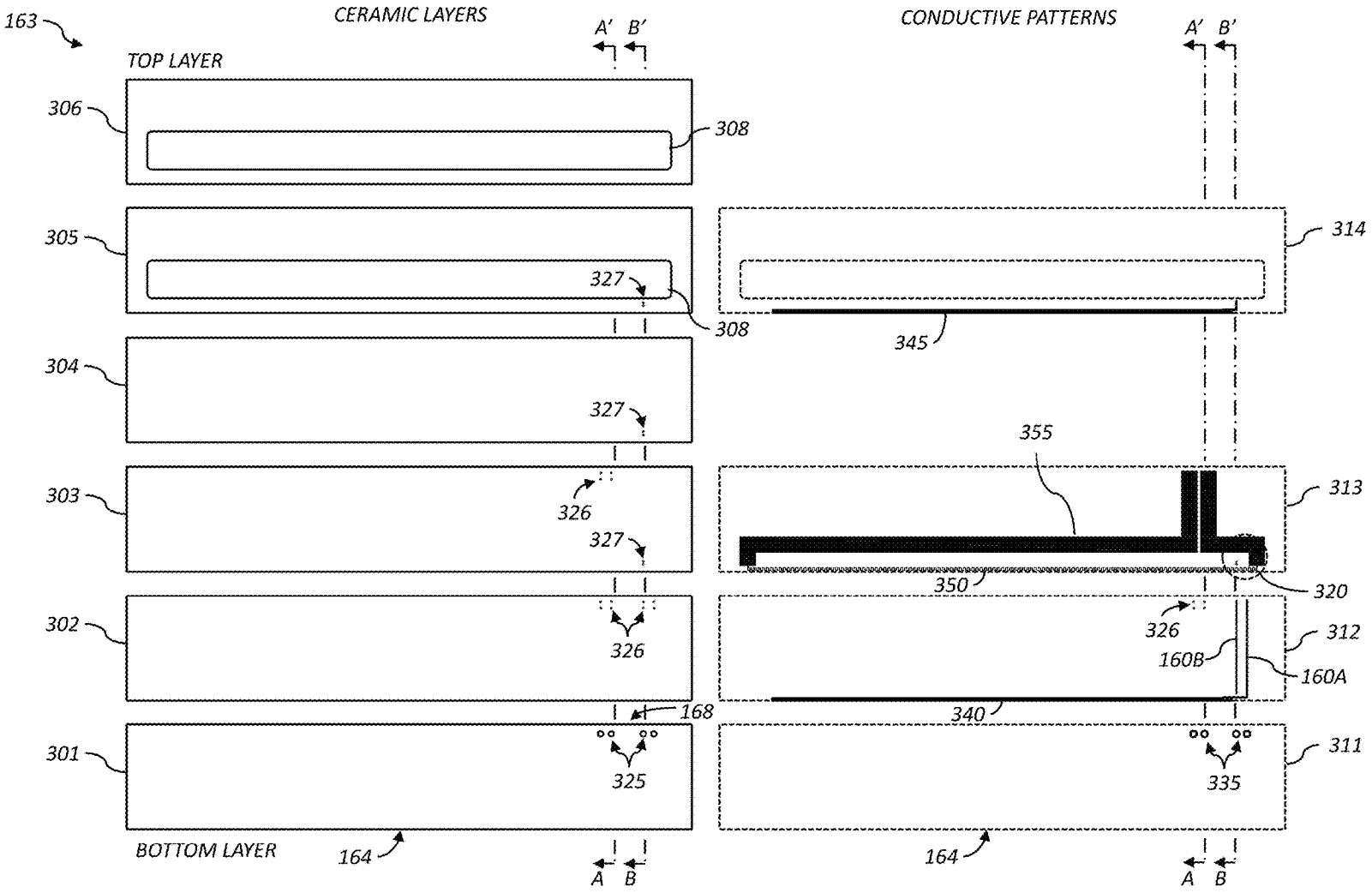
FIG. 7 shows plan views of the ceramic layers and conductive patterns used to form an exemplary charging device body.

FIG. 7 shows plan views of six different non-conductive ceramic layers 301, 302, 303, 304, 305, 306 and four conductor patterns 311, 312, 313, 314 that are applied to some of the ceramic layers 301-306 during the fabrication of the charging device body 163 (FIG. 3) according to an embodiment of the invention. The left side of FIG. 7 shows the six ceramic layers 301-306 starting with ceramic layer 301, which is the bottom layer closest to the ink catcher 72 (FIG. 3), up through ceramic layer 306, which is the top layer closest to the nozzle plate 49. The right side of FIG. 7 shows the four conductor patterns 311-314, each conductor pattern 311-314 being applied to the upper surface of the corresponding ceramic layer 301-303, 305 that is to the left of it. For these plan views, the charging face 164 of the charging device body 163 is to the bottom of the view, and the interconnect region 168 for supplying signals to the charging electrode 162 is toward the upper right.

The bottom ceramic layer 301 includes four large vias 325 through which signals can pass from a connector to the different internal conductor layers. In the second ceramic layer 302 two smaller vias 326 are used for each of the large vias 225 of the bottom ceramic layer 301. To enable interconnection between these different vias 325, 326, the conductor pattern 311 applied to the upper surface of the bottom ceramic layer 301 has conductive rings 335 encircling each of the large vias 325. The vias are filled with conductive material during the fabrication of the charging device body 163 to pass electrical signals between the conductor patterns 311-314.

The conductor pattern 312 applied over the upper surface of the second ceramic layer 302 has conductive traces 160A, 160B extending from two of the vias 325 toward the charging face 164 of the charging device body 163. One of these conductive traces 160A extends all the way to the charging face 164 of the ceramic layer 302, and from there extends laterally along the edge of the ceramic layer 302. On the completed charging device 161, the exposed edge of this conductive trace 160A, which extends across the length of the nozzle array, can serve as a sensing electrode 340. The use of such a sensing electrode 340 will be discussed later.

The second conductive trace 160B trace stops short of the charging face 164 for connection through the vias 327 located near the charging face 164 of the ceramic layers 303, 304, 305 to the conductor patter 314. The conductor pattern 314 extends from the vias 327 to the charging face 164 of the charging device body 163, and extends as a conductive trace 345 along the edge to provide electrical connection to the charging electrode 162 of the charging device 161. In a preferred embodiment, the conductive trace 345 extends along the edge to span the length of the nozzle array. By so doing, it ensures electrical contact to the entire charging electrode even if a portion of the charging electrode were damaged to produce an electrical break in the charging electrode somewhere along its length.

Figure 8:
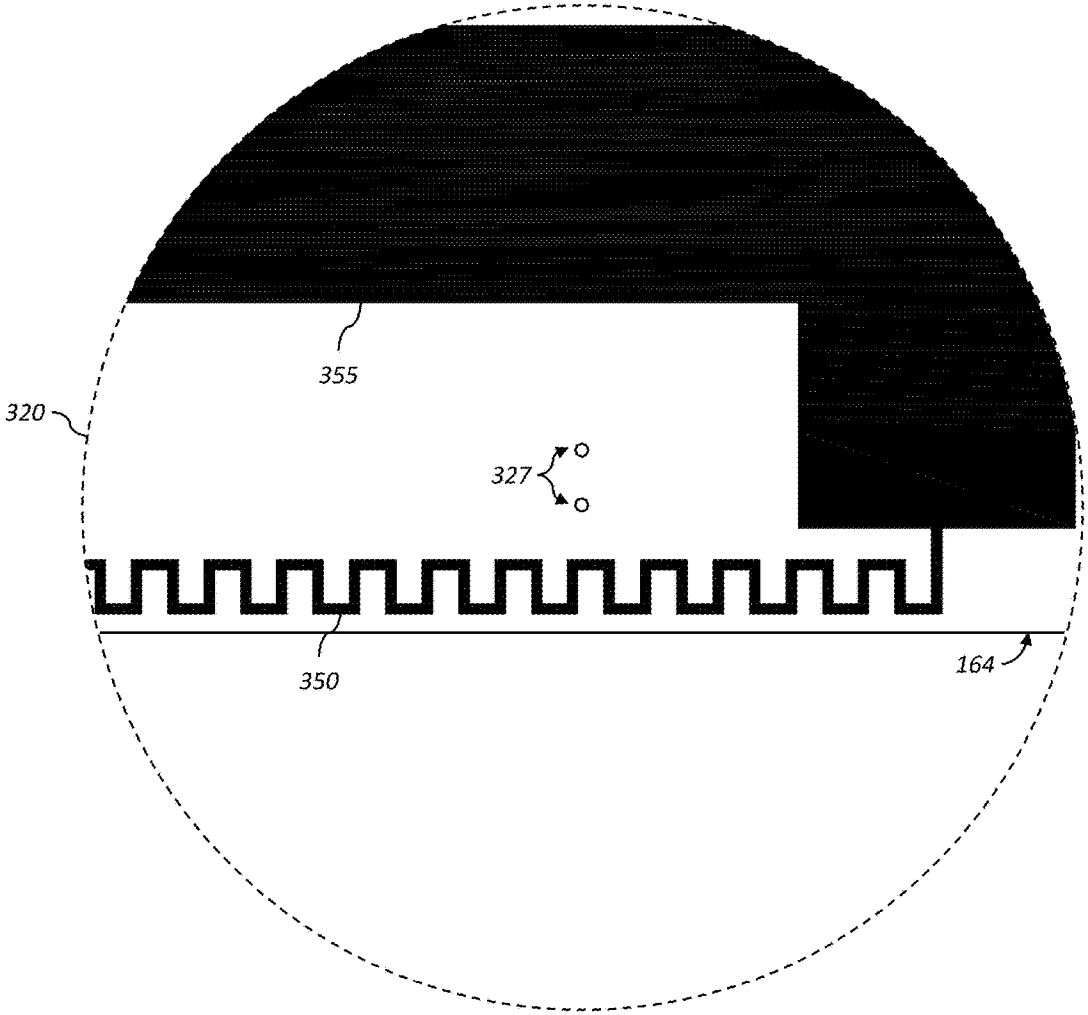
FIG. 8 shows a close up of a portion of the conductive pattern forming the heater in FIG. 7.

The conductor pattern 313 forms a heater 350 for the charging device 161. FIG. 8 shows a close-up view of a portion of the heater 350 in region 320. The heater 350 has a serpentine pattern that is recessed away from the charging face 164. The serpentine heater 350 is formed using the same materials as the wider conductive traces 355 that supply current to the heater 350. The conductive traces 355 are electrically connected through the vias 325, 326 to a power source (not shown) connected to an electrical connector in the interconnect region 168.

The ceramic layers 305-306 each include an opening 308. When the charging device body 163 is assembled, the openings 308 form a recessed region in the top surface of the charging device body 163. The recessed region provides space for nozzle plate 49 interconnections.

The ceramic layers 301-306 with the applied conductor patterns 311-314 are laminated together and are sintered or co-fired together to form the charging device body 163 with internal conductive traces 160 passing through the interior of the charging device body 163 connecting between the charging face 164 and the electrical connector which is attached in the interconnect region 168, which is remote from the charging face. In an exemplary embodiment, the electrical connector is attached to the charging device body on the lower surface of the bottom ceramic layer 301 in electrical connection with the conductive material extending through the vias 325. Preferably, the electrical connector is a flexible circuit that is connected to the metal-filled large vias 335 using an appropriate process such as a soldering process, or using an anisotropic conductive film adhesive.

Figure 9:
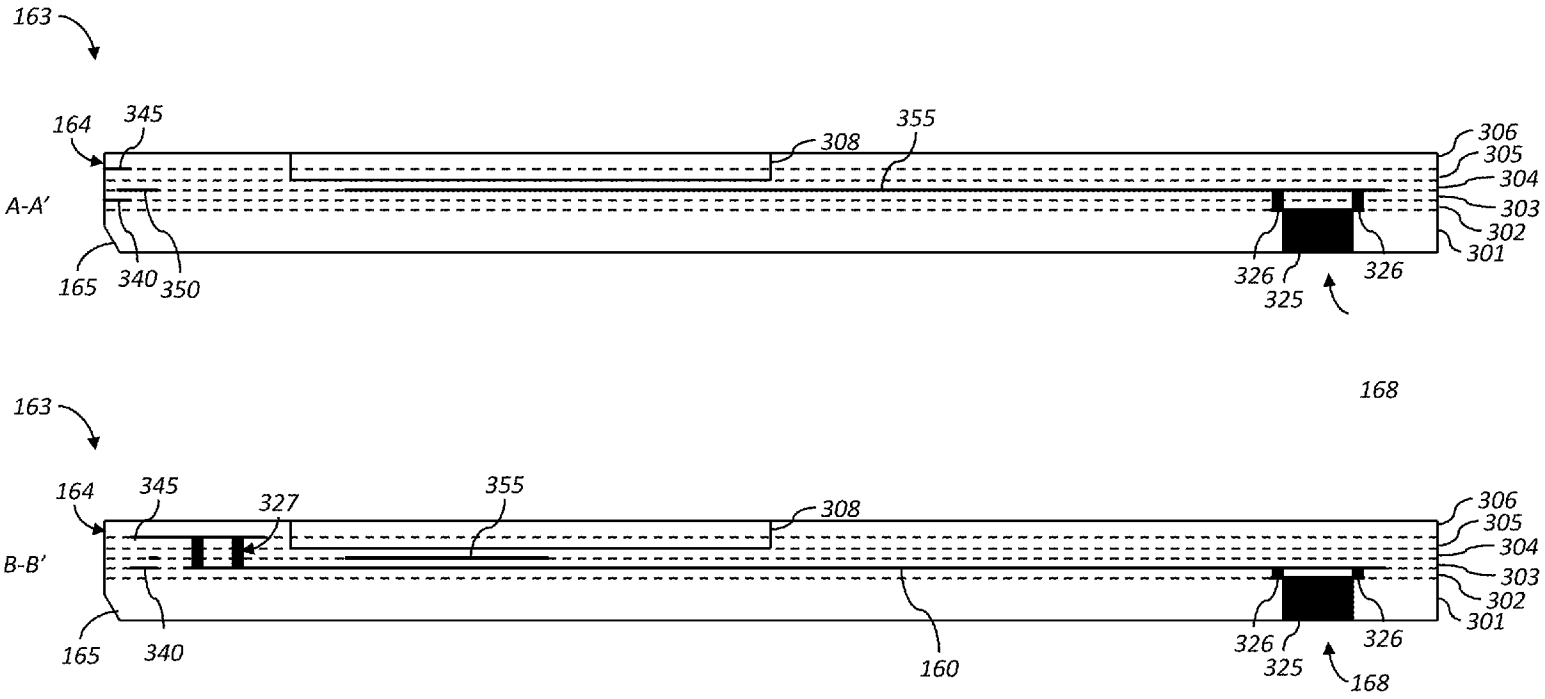
FIG. 9 shows two cross sectional views of the charging device body formed using the layers of FIG. 7.

Following the co-firing of the assembled charging device body 163, the charging face 164 is preferably ground to form the desired vertical and chamfered surfaces 165 (FIG. 9). Typically, the grinding operation results in the vertical charging face 164 and the chamfered surfaces 165 each having a flatness of between 5 and 15 microns.

FIG. 9 shows two cross-section views of the charging device body 163 taken through the A-A' and B-B' cut lines shown in FIG. 7. The A-A' cross-section passes through the vias 325, 326 for one of the conductive traces 355 for the heater 350. The B-B' cross-section passes through the vias 325, 326, 327 and the conductive trace 160 that make an electrical connection conductive trace 345 and then to the charging electrode 162 (FIG. 3).

In some embodiments, the exposed portions of the sensing electrode 340 and the conductive trace 345 on the charging face 164 and at the exposed conductors in the interconnect region 168 are electrolessly plated with a thin layer of nickel, or with a combination of nickel and gold. This electroless plating can be done as the tungsten typically used for the conductive patterns 311-314 can otherwise oxidize to the point that it is difficult to make electrical contact with the conductive traces at either the interconnect region 168 or on the charging face 164.

Figure 10:
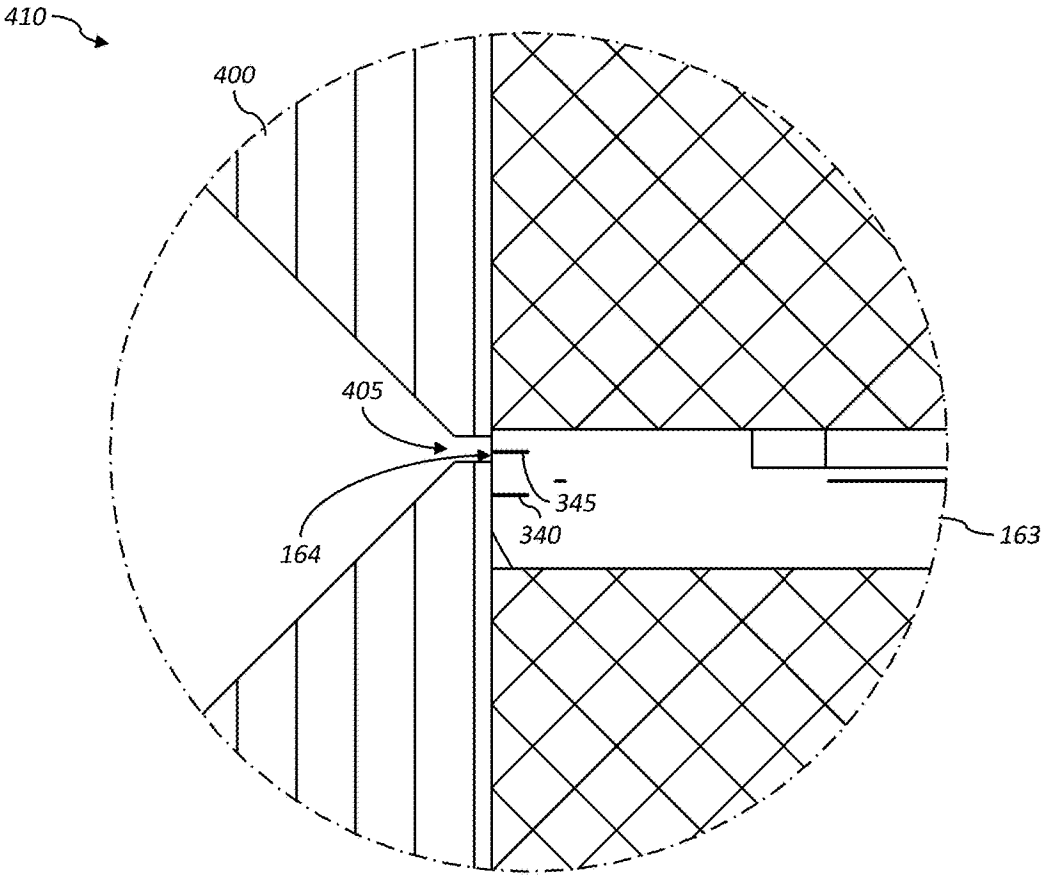
FIG. 10 shows a cross-sectional view of a shadow mask used during the deposition of the conductive base layer on the charging face of the charging device.
Figure 11:
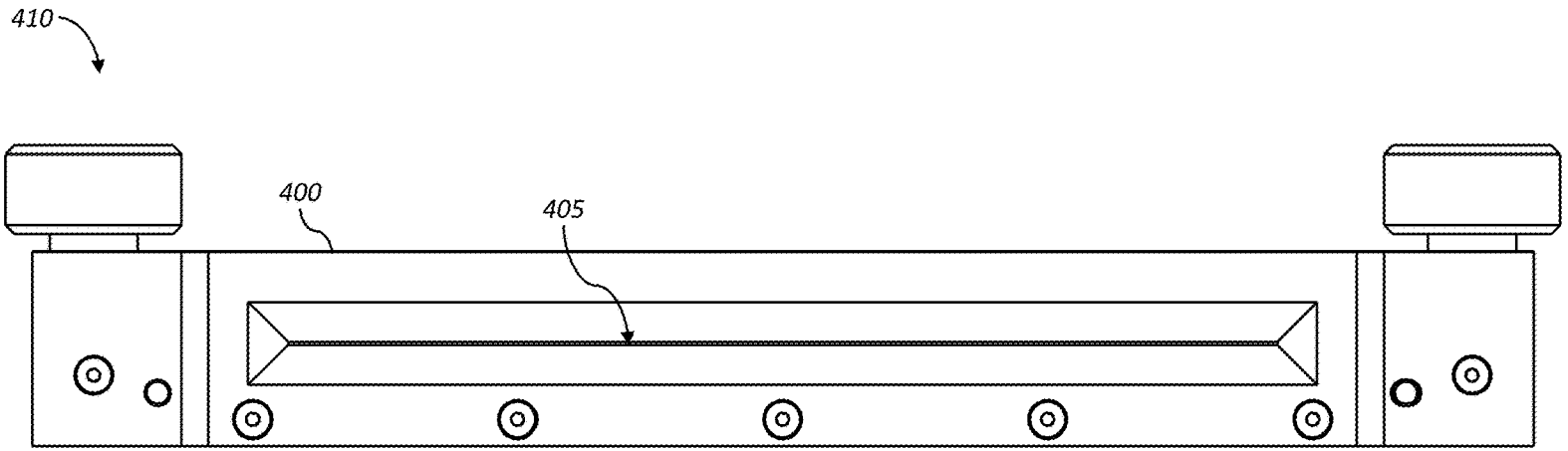
FIG. 11 shows a front view of the shadow mask in FIG. 10.

The deposit conductive base layer step 210 of FIG. 6 involves using a shadow mask 400 to define the pattern of the base layer 166 (FIG. 3). FIG. 10 shows a cross section of a portion of the charging device body 163 positioned within a shadow mask assembly 410 including the shadow mask 400 for performing the vapor deposition process. The shadow mask 400 has a mask opening 405 adjacent to the portion of the charging face 164 on which the base layer 166 is to be formed. This portion of the charging face 164 includes the exposed portion of the conductive trace 345 for connecting to the charging electrode 162 (FIG. 3). FIG. 11 shows a front view of the shadow mask 400 in the shadow mask assembly 410. The mask opening 405 can be seen to be a slit that extends lengthwise a distance sufficient to span the length of the nozzle array in the printhead 30 (FIG. 3).

In the configuration illustrated in FIG. 10, the shadow mask 400 prevents deposition of the conductive base layer 166 on the portion of the charging face 164 that includes the exposed portion of the sensing electrode 340. It also prevents deposition of the conductive base layer 166 on the upper face of the charging device body 163 or even on the corner between the charging face 164 and the top face of the charging device 161. In some embodiments, the shadow mask 400 is used for the vapor depositing both a chromium layer and a copper layer to form the base layer 166. Preferably the shadow mask 400 is made of a material such as stainless steel that is impervious to the cleaning methods used to remove the copper and chromium layer from the shadow mask 400. Suitable cleaning methods include chemical etchants that attacks copper and chromium but not the material of the shadow mask 400 and soda blasting to remove the copper and chromium from the shadow mask 400.

In other embodiments, the mask opening 405 may be sized to allow the deposited conductive base layer 166 to contact the exposed portions of the conductive trace 345 and the sensing electrode 340. In such embodiments, the optional ablate portion of base layer step 220 is used to isolate a first portion of the conductive base layer 166 that contacts the conductive trace 345 from a second portion of the conductive base layer 166 that contacts the sensing electrode 340. As the base layer 166 is quite thin, it can be removed readily using ablative processes. The ablative processes can include laser ablation and e-beam ablation processes.

With the charging device body 163 in place within the shadow mask assembly 410, the shadow mask assembly 410 can be placed within a vapor deposition system (e.g., a chemical vapor deposition system or a physical vapor deposition system) and a base layer 166 of conductive material is deposited onto the charging face 164 of the charging device 161 (FIG. 3).

In a preferred embodiment, the deposit conductive base layer step (FIG. 6) involves first depositing an adhesion layer on the charging face 164 and then depositing a higher conductivity layer onto the adhesion layer. For example, the adhesion layer can be a chromium or titanium layer. Chromium is preferred as it is easier to remove should it be necessary to rework the charging device 161. A preferred higher conductivity layer is copper. Preferably the chromium layer has a thickness in the range of 60 to 200 nm, and the copper layer has a thickness of 500 to 1000 nm. The chromium layer enhances the adhesion of the subsequent layers to the ceramic charging device body 163. The deposited copper layer enhances the adhesion of the subsequent layers to the chromium layer and it enhances the conductance needed for subsequent plating operations.

As the charging device body 163 is pushed tightly against the shadow mask 400 there is minimal overspray onto charging face 164 beyond the perimeter of the shadow mask opening 405. However, if the overspray of the vapor deposition operation is excessive, or if very fine detail is required, which cannot be achieved using the shadow mask 400, then the optional ablate portion of base layer step 220 can be used to refine the boundaries or perimeter of the deposited base layer 166. As the base layer 166 is quite thin, it can be removed readily using an ablation process. Appropriate ablative processes can include laser ablation and e-beam ablation processes.

In other embodiments, the mask opening 405 may be sized to allow the deposited conductive base layer 166 to contact the exposed portions of the conductive trace 345 and the sensing electrode 340. In such embodiments, the optional ablate portion of base layer step 220 is used to isolate a first portion of the conductive base layer 166 that contacts the conductive trace 345 from a second portion of the conductive base layer 166 that contacts the sensing electrode 340. As the base layer 166 is quite thin, it can be removed readily using ablative processes.

In plate conductive metallic layer step 230 of FIG. 6, the portion of the charging device 161 that includes the charging face 164 (but not the interconnect portion 168 of the charging device 161) is immersed in a plating tank and a conductive layer is plated onto the deposited base layer 166. The plating process can be either an electroless plating process or a conventional electroplating process.

In an electroless plating process, the conductive base layer 166 serves as the catalyst for the electroless plating process so that the boundaries of the deposited base layer 166 define the boundaries of the charging electrode 162, with the electroless plating process extending the charging electrode 162 past the boundaries of the base layer 166 by an amount approximately equal to the thickness of the electroplated conductive layer. The electroless plated conductive layer therefore encapsulates the base layer 166.

In an electroplating process, the conductive layer can only plate onto the immersed portion of the charging device 161 that is electrically connected to the electroplating power supply. With the deposited base layers immersed in the plating bath and connected by means of the internal conductive trace 160A and an electrical connection at the interconnect region 168 (which is not immersed in the electroplating bath) to the electroplating power supply, the conductive metallic layer only plates onto the deposited base layer. Therefore, the boundaries of the deposited base layer 166 define the boundaries of the electroplated conductor with the electroplated conductive layer growing laterally beyond each boundary of the deposited base layer 166 by an amount approximately equal to the thickness of the electroplated conductive layer. The overgrowth of the electroplated conductive layer past the boundaries of the deposited base layer 166 serves to encapsulate the base layer 166, protecting it from possible corrosion. With either electroless plating or electroplating, the boundaries of the deposited base layer 166 should therefore be selected to account for the overgrowth by the plated conductive layer.

In a preferred embodiment, the plate conductive metallic layer step 230 forms a two-layer charging electrode 162. The plating process includes a first plating operation where a first high-conductivity metallic layer (e.g., copper) is plated onto the base layer 166 and a second plating operation where a second corrosion-resistant metallic layer (e.g., nickel) is plated onto the plated high-conductivity metallic layer. The high-conductivity metallic layer ensures sufficiently uniform conductance across the charging face to enable uniform plating of the following nickel layer. As the process for plating this high-conductivity metallic layer is much more efficient than the deposition of a high-conductivity layer by the vapor deposition process, typically the plated high-conductivity metallic layer is thicker than the vapor deposited high-conductivity layer of the conductive base layer 166. Preferably the high-conductivity metallic layer is of the same metal as the high-conductivity layer of the conductive base layer 166, preferably copper. The plated copper layer, in addition to providing enhanced conductance for the subsequent plating of the nickel layer, also provides a solid base for adhesion of the nickel layer. Without the plated copper layer, the stresses produced during nickel plating might be sufficient to separate the deposited base layers 166 from the charging device body 163. The nickel layer is preferably plated onto the charging device 161 using a low-stress nickel plating bath to reduce the risk of delaminating from the ceramic charging device body 163. The chemistries of such low stress plating baths are known in the art of both electroplating and electroless plating. The nickel layer provides the corrosion resistance needed for a charging electrode 162 that contacts the common inkjet inks. Preferably the plated copper layer has a thickness in the range of 1500 to 3000 nm, and the plated nickel layer has a thickness in the range of 20 to 40 microns.

In a preferred embodiment, the outermost plated conductive layer (e.g., the nickel layer) of the charging electrode 162 is plated to a thickness sufficient to allow a portion of the plated conductive layer to be lapped away in lap electroplated conductor step 240. The lapping step is carried out to provide the outer face of the charging electrode 162 with the flatness desired for uniform drop charging and deflecting; any deviations from flatness are preferably less than 5 microns. The lapping process yields a charging electrode 162 that is flatter than can be obtained by grinding the charging device body 163.

Figure 12A:
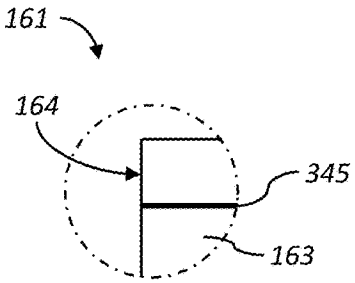
FIGS. 12A-12F shows close-up cross-sectional views of the charging face of the charging device at various points in the process of forming the charging electrode.

FIGS. 12A-12F show cross-sectional views of the charging face 164 at various points in the process of forming the charging device 161. FIG. 12A shows the bare charging device body 163 provided by the provide charging device body step 200 (FIG. 6). As discussed earlier, the charging device body 163 includes an internal conductive trace 160 (FIG. 3) that is electrically connected to the conductive trace 345 which is exposed on the charging face 164.

Figure 12B:
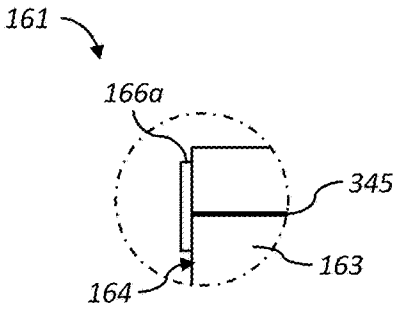
Figure 12C:
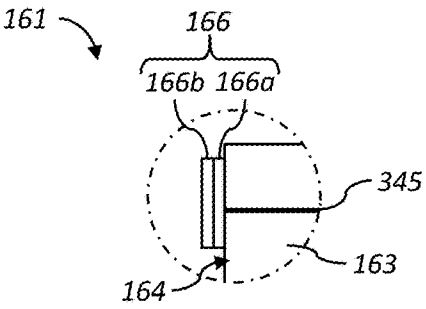

FIGS. 12B-12C show the formation of the base layer 166 using the deposit conductive base layer step 210 (FIG. 6). FIG. 12B shows the results of depositing a first chromium layer 166*a* and FIG. 12C shows the results of depositing a second copper layer 166*b*. Together, the chromium layer 166*a* and the copper layer 166*b* provide the conductive base layer 166.

Figure 12D:
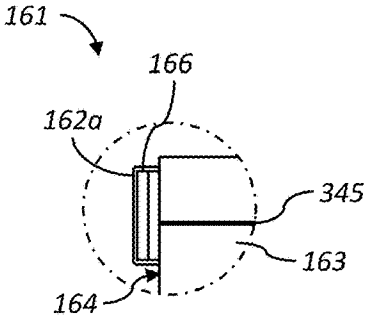
Figure 12E:
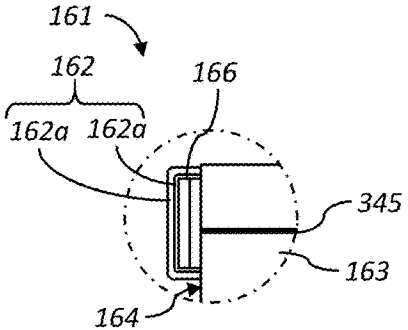

FIGS. 12D-12E show the formation of the charging electrode 162 using the plate conductive metallic layer step 230. FIG. 12D shows the results of plating a first copper layer 162*a*, and FIG. 12E shows the results of plating a second nickel layer 162*b*. Together, the copper layer 162*a* and the nickel layer 162*b* provide the charging electrode 162. It can be seen that the layers of the charging electrode 162 encapsulate the base layer 166 to protect them from possible corrosion.

Figure 12F:
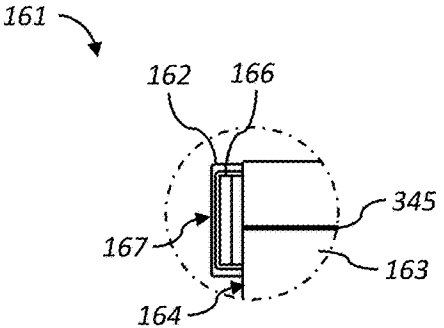

FIG. 12F shows the results of applying the lap electroplated conductor step 240. The lapping process removes a portion of the surface of the charging electrode 162 to provide a lapped surface 167 having the required flatness.

The combination of using a charging device body 163 with a conductive trace 160 passing through the interior of the charging device body 163 from charging face 164 to the electrical connector with the step of depositing the base layer 166 on the charging face 164 using a shadow mask 400 makes it is possible to define the boundaries of the charging electrode 162 without the need for photomasking operations. This allows the upper edge of the charging electrode 162 to be placed with high accuracy to under 75 microns from the corner between the charging face 164 and the top face of the charging device 161, and preferably between 25 and 30 microns from the top corner of the charging device 161, which cannot readily be done using photomasking operations to define the upper boundary of the charging electrode 162.

As discussed previously, a heater 350 (FIG. 8) can be patterned for inclusion between the ceramic layers 303, 304 of the charging device body 163. The co-firing process totally encapsulates the heater 350 making it immune to attack by the inkjet inks or other fluids. The encapsulation of the heater 350 also provides excellent thermal contact between the heater 350 and the ceramic charging device body 163. This process yields a charging device heater 350 that is placed in close proximity to the charging face 164 of the charging device 161 where it is most effective in preventing condensation of the charging face 164. This allows much lower heater power to be used (e.g., 4-6 watts) than has been required with prior art heaters (e.g., 25-30 watts) that were adhesively bonded to the bottom of the charging device 161, between the charging device 161 and the catcher 72 (FIG. 3). Embedding the heater 350 between the ceramic layers 303, 304 so close to the charging face 164 has also been found to reduce the thermal expansion produced by the heating of the charging device 161. With the charging device 161 of the present invention having the embedded heater 350, thermal expansion has been found to change the spacing between the charging electrode 162 and the liquid stream 52 by only 1 to 3 microns, whereas prior art charging device heaters have been found to produce thermal expansion that changes the spacing between the charging electrode 162 and the liquid stream 52 by as much as 12 to 30 microns.

Figure 13:
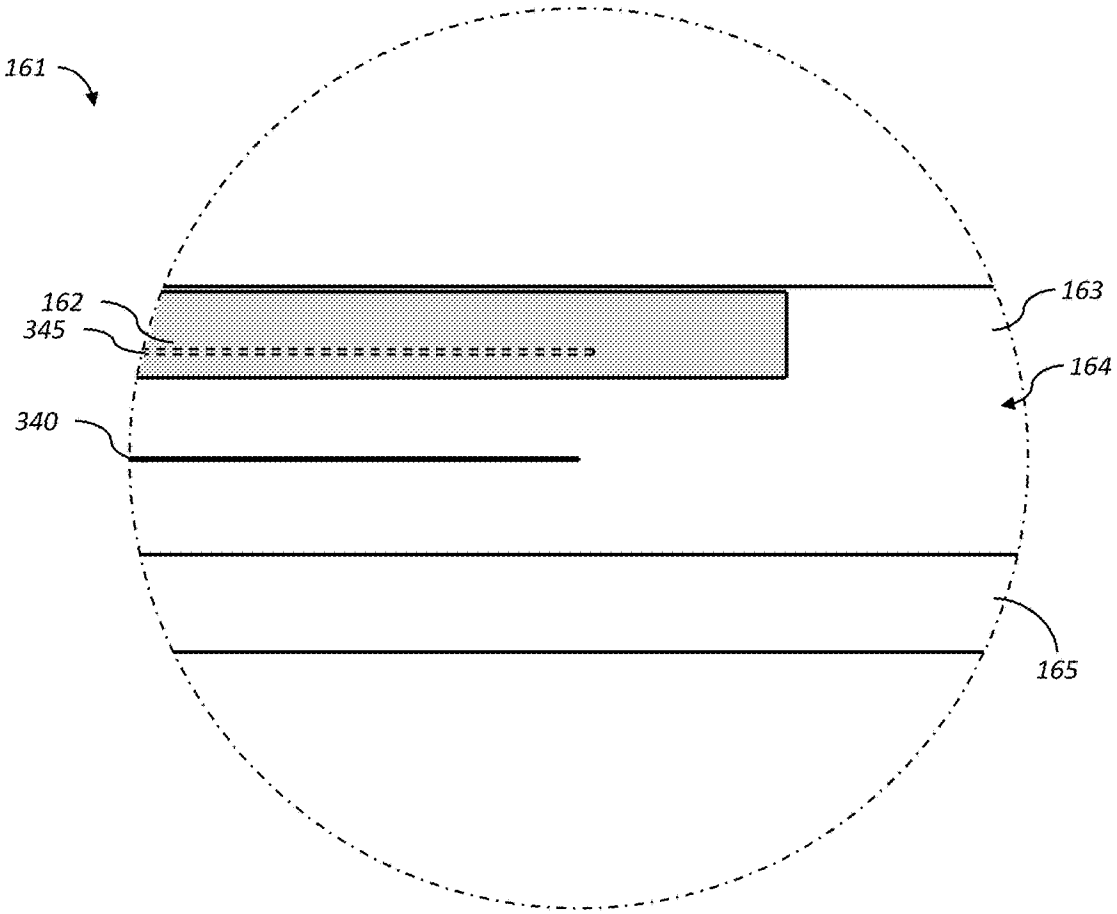
FIG. 13 shows a close-up front view of a portion of the charging face of the charging device according to an exemplary embodiment of the invention.

FIG. 13 shows a front view of a portion of the charging face 164 of the charging device 161. The use of the internal conductive trace 160 (FIG. 3) for the charging electrode 162 allows the charging electrode 162 to be formed with clean, well-defined borders. It eliminates the need to wrap the conductive trace connected to the charging electrode 162 around either the top or bottom corners of the charging device 161. By eliminating the need for the conductive trace on the top of the charging device 161 it eliminates the need to apply a protective insulating layer over the conductive trace, which can reduce the gap between the charging device 161 and the nozzle plate 49 and make sealing that gap more difficult. Likewise, by avoiding the need to wrap the conductive trace around the bottom of the charging device 161, it eliminates the need to apply a protective insulating layer over the conductive trace to protect it against shorting to the ink catcher 72. It also facilitates the placement of a sensing electrode 340 on the charging face 164 below the charging electrode 162.

Figure 14:
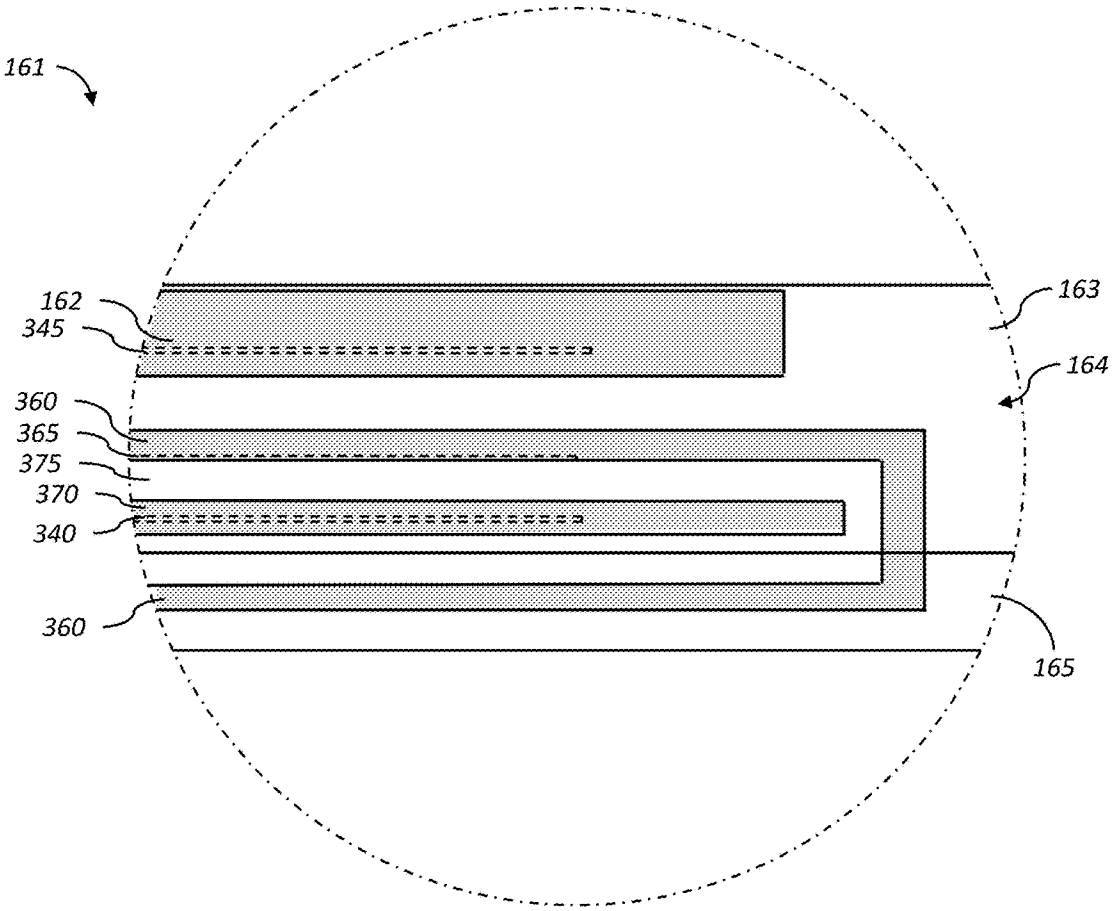
FIG. 14 shows a close-up front view of a portion of the charging face of the charging device according to another embodiment of the invention.

The sensing electrode 340 can be a short detection electrode as shown in FIG. 13. The use of such a short detection electrode is described in commonly-assigned European patent EP1013426. In the embodiment of FIG. 14, the exposed portion of the sensing electrode 340 serves as the short detection electrode. No conductive base layer 166 is vapor deposited onto the exposed portion of the sensing electrode 340. To prevent electroplating onto the exposed portion of the sensing electrode 340, the sensing electrode 340 is not connected to the plating power supply during the electroplating operations.

In another embodiment, the sensing electrode 340 can be used to provide a drop charge detection electrode for capacitively detecting the charge on drops passing the sensing electrode 340. As shown in FIG. 14, in some configurations, an external electrode 370 can be applied on the charging face 164 in electrical contact with the internal sensing electrode 340. The external electrode can be formed using a similar process that was discussed above relative to the formation of the charging electrode 162. As has been disclosed in the U.S. Pat. No. 3,852,768 and U.S. Pat. No. 6,367,917, such sensing electrodes 340 are preferably surrounded by a shielding electrode 360 as shown in FIG. 14. The shielding electrode 260 is separated from the sensing electrode 340 by a gap 375. In the illustrated configuration, the shielding electrode 360 extends onto the chamfered surface 165 of the charging face 164. In an exemplary embodiment, the charging device body 163 can include an additional ceramic layer to provide an internal conductive trace 365 that connects the shielding electrode 360 on the charging face 164 to the electrical connector in the interconnect region at the rear of the charging device 161. This additional shielding electrode 360 can help to shield the sensing electrode 340 from electronic noise. Laser ablation can be used to remove the deposited metal layers from the charging face 164 prior to the plating steps to help isolate the sensing electrode 340 from the shielding electrode 360, and to help isolate the shielding electrode 360 from the charging electrode 162.

The invention has been described in detail with particular reference to certain preferred embodiments thereof, but it will be understood that variations and modifications can be effected within the spirit and scope of the invention.

PARTS LIST

20 printing system
22 image source
24 image processing unit
26 control circuits
27 synchronization device
28 drop-forming transducer
30 printhead
32 print medium
34 print medium transport system
35 speed measurement device
36 media transport controller
38 micro-controller
40 ink reservoir
44 ink recycling unit
46 ink pressure regulator
47 ink channel
48 jetting module
49 nozzle plate
50 nozzle
51 heater
52 liquid stream
54 drop
55 drop-formation waveform source
57 trajectory
59 breakoff point
60 drop formation waveform sequence
61 charging device
62 charging electrode
63 charging-electrode waveform source
64 charging-electrode waveform
65 large drop
**65*a*** drop
**65*b*** drop
66 printing drop
68 non-printing drop
69 drop selection system
70 deflection mechanism
71 deflection electrode
72 ink catcher
74 catcher face
76 ink film
78 liquid channel
79 lower plate
80 charging-electrode waveform period
82 first voltage state
84 second voltage state
86 non-print trajectory
88 print dot
92-1 large-drop drop-formation waveform
92-2 large-drop drop-formation waveform
92-3 large-drop drop-formation waveform
94-1 small-drop drop-formation waveform
94-2 small-drop drop-formation waveform
94-3 small-drop drop-formation waveform
94-4 small-drop drop-formation waveform
96 period
97-1 printing-drop drop-formation waveform
97-2 printing-drop drop-formation waveform
98 pulse
99 arrow
100 period
102 pulse
104-1 large drop
104-2 large drop
104-3 large drop
106-1 small drop
106-2 small drop
106-3 small drop
106-4 small drop
109 phase shift

160 conductive trace
160A conductive trace
160B conductive trace
161 charging device
162 charging electrode
162*a* copper layer
162*b* nickel layer
162' charging electrode
163 charging device body
164 charging face
165 chamfered surface
166 base layer
166*a* chromium layer
166*b* copper layer
167 lapped surface
168 interconnect region
200 provide charging device body step
210 deposit conductive base layer step
220 ablate portion of base layer step
230 plate conductive metallic layer step
240 lap electroplated conductor step
301 ceramic layer
302 ceramic layer
303 ceramic layer
304 ceramic layer
305 ceramic layer
306 ceramic layer
308 opening
311 conductor pattern
312 conductor pattern
313 conductor pattern
314 conductor pattern
320 region
325 via
326 via
327 via
335 conductive ring
340 sensing electrode
345 conductive trace
350 heater
355 conductive trace
360 shielding electrode
365 conductive trace
370 external electrode
375 gap
400 shadow mask
405 mask opening
410 shadow mask assembly

The invention claimed is:

1. A method of fabricating a charging device for an inkjet printing system, comprising:

providing a charging device body having at least one conductive trace passing through the interior of the charging device body connecting between a charging face of the charging device body and an interconnection region remote from the charging face, a portion of the at least one conductive trace being exposed on the charging face;

using a vapor deposition process to deposit a conductive base layer through a shadow mask onto the charging face, the deposited conductive base layer contacting the exposed portion of at least one conductive trace; and plating one or more conductive metallic layers onto the deposited conductive base layer to form a charging electrode.

2. The method of claim 1, further including using a lapping process on the charging electrode.

3. The method of claim 2, wherein the charging electrode is lapped to a flatness of 5 microns or less.

4. The method of claim 1, wherein the conductive base layer includes a plurality of layers, and wherein the step using a vapor deposition process to deposit a conductive base layer includes vapor deposition of a first adhesion layer and vapor deposition of a second conductive layer onto the adhesion layer, wherein the second conductive layer has a higher conductivity than the first adhesion layer.

5. The method of claim 4, wherein the first adhesion layer is a chromium layer.

6. The method of claim 4, where the second conductive layer is a copper layer.

7. The method of claim 1, wherein the step of plating one or more conductive metallic layers includes plating a first high-conductivity metallic layer onto the base layer and plating a second corrosion-resistant metallic layer onto the high-conductivity metallic layer.

8. The method of claim 7, wherein the high-conductivity metallic layer is a copper layer.

9. The method of claim 7, wherein the corrosion-resistant metallic layer is a nickel layer.

10. The method of claim 1, wherein the step of providing a charging device body includes providing a plurality of ceramic layers, wherein at least one of the ceramic layers includes at least one conductive trace on one of its faces, and where the face of the ceramic layer that includes the at least one conductive trace is co-fired to a face of another of the plurality ceramic layers.

11. The method of claim 10, further comprising providing a heater circuit on a face of one of the plurality of ceramic layers that is co-fired to a face of another of the plurality of ceramic layers, the heater circuit being located adjacent to, but spaced apart from the charging face of the charging device body.

12. The method of claim 1, further including the step of ablatively removing a portion of the deposited conductive base layer prior to the step of plating one or more conductive metallic layers onto the deposited conductive base layer.

13. The method of claim 12, wherein the step of ablatively removing a portion of the deposited conductive base layer separates a first portion of the conductive base layer that contacts the exposed portion of a first conductive trace from a second portion of the conductive base layer that contacts an exposed portion of a second conductive trace.

14. The method of claim 13, wherein the step of plating one or more conductive metallic layers includes plating onto both the first and second portions of the conductive base layer.

15. The method of claim 1, wherein the charging device body includes an edge between the charging face and a second face of the charging device body, and wherein the charging electrode on the charging face extends to within 75 microns of the edge but does not extend beyond the edge.

16. The method of claim 1, wherein the exposed portion of the at least one conductive trace extends across a width of the charging face corresponding to a length of a nozzle array in a printhead of the inkjet printing system.

17. The method of claim 1, wherein the shadow mask has a shadow mask opening that enables the conductive base layer to be deposited onto the charging face in contact with the exposed portion of a first conductive trace and prevents the conductive base layer from contacting the exposed portion of a second conductive trace.

18. The method of claim 17, wherein the step of plating one or more conductive metallic layers does not include plating onto the exposed portion of the second conductive trace.

* * * * *